US010814196B2

(12) United States Patent
Chen et al.

(10) Patent No.: US 10,814,196 B2
(45) Date of Patent: Oct. 27, 2020

(54) SYNTHETIC SHUTTLECOCK

(71) Applicant: VICTOR RACKETS INDUSTRIAL CORP., Taipei (TW)

(72) Inventors: Shu-Jung Chen, Taipei (TW); Tzu-Wei Wang, Taipei (TW); Hsin-Chen Wang, Taipei (TW); Cheng-Yu Chang, Taipei (TW)

(73) Assignee: Victor Rackets Industrial Corp., Taipei (TW)

( * ) Notice: Subject to any disclaimer, the term of this patent is extended or adjusted under 35 U.S.C. 154(b) by 0 days.

(21) Appl. No.: 16/661,093

(22) Filed: Oct. 23, 2019

(65) Prior Publication Data

US 2020/0206595 A1 Jul. 2, 2020

(30) Foreign Application Priority Data

Dec. 26, 2018 (TW) ..... 107147200 A

(51) Int. Cl.
*A63B 67/187* (2016.01)
*A63B 67/19* (2016.01)
*A63B 102/04* (2015.01)

(52) U.S. Cl.
CPC ..... *A63B 67/19* (2016.01); *A63B 2102/04* (2015.10); *A63B 2209/00* (2013.01)

(58) Field of Classification Search
CPC ..... A63B 67/18; A63B 67/187; A63B 67/19
USPC ..... 473/579, 580
See application file for complete search history.

(56) References Cited

U.S. PATENT DOCUMENTS 2,163,236 A * 6/1939 Collier ..... A63B 67/18 473/579
2,212,079 A * 8/1940 Saunders ..... A63B 67/187 473/579
2,626,806 A * 1/1953 Carlton ..... A63B 67/193 473/579
2,734,746 A * 2/1956 Sametz et al. ..... A63B 67/187 473/579
2,830,817 A * 4/1958 Schoberl ..... A63B 67/187 473/579
3,904,205 A * 9/1975 Robinson ..... A63B 67/193 473/579
4,305,589 A * 12/1981 Popplewell ..... A63B 67/193 473/579

(Continued)

FOREIGN PATENT DOCUMENTS

TW 539370 4/2017

*Primary Examiner* — Alexander R Niconovich
(74) *Attorney, Agent, or Firm* — Alan D. Kamrath; Karin L. Williams; Mayer & Williams PC

(57) ABSTRACT

The present disclosure discloses a synthetic shuttlecock, which includes a base portion, a plurality of stems, and a plurality of feathers. One end of each of the stems is inserted into the base portion. Two of the feathers are connected to one of the stems. A connecting portion is formed on the stem, respectively. Each of the feathers has a first length and a first width. Each of the feathers has two holes, the two holes are located on the two sides of the connecting portion respectively, and the holes are close to a front end of the connecting portion. Each of the holes has a second length and a second width. The ratio of the second length to the first length is between 0.22 and 0.31, and the ratio of the second width to the first width is between 0.06 and 0.28.

12 Claims, 7 Drawing Sheets

(56) References Cited

U.S. PATENT DOCUMENTS

| | | | | | |
|---|---|---|---|---|---|
| 4,509,761 | A * | 4/1985 | Liu | A63B 67/193 | 473/579 |
| 4,538,818 | A * | 9/1985 | Sinclair | A63B 67/193 | 473/579 |
| 4,657,262 | A * | 4/1987 | Buckland | A63B 67/19 | 473/580 |
| 5,421,587 | A * | 6/1995 | Mao-Huang | A63B 67/187 | 473/579 |
| 5,853,340 | A * | 12/1998 | Willis | A63B 67/193 | 473/579 |
| 6,709,353 | B1 * | 3/2004 | Peterson | A63B 67/18 | 473/579 |
| 6,890,274 | B2 * | 5/2005 | Carlton | A63B 67/18 | 473/579 |
| 9,061,193 | B2 * | 6/2015 | Dai | A63B 67/18 | |
| 9,132,328 | B1 * | 9/2015 | Daole | A63B 67/18 | |
| 9,937,399 | B1 * | 4/2018 | Peterson | A63B 67/187 | |
| 10,576,346 | B2 * | 3/2020 | Sakaguchi | A63B 67/19 | |
| 2010/0311526 | A1 * | 12/2010 | Tanaka | A63B 67/187 | 473/579 |
| 2013/0210564 | A1 * | 8/2013 | Yoneyama | A63B 67/19 | 473/580 |
| 2017/0291085 | A1 * | 10/2017 | Chen | A63B 67/19 | |
| 2019/0151735 | A1 * | 5/2019 | Matsushima | A63B 67/19 | |

* cited by examiner

| | Synthetic shuttlecock 1 | Synthetic shuttlecock 9 |
|---|---|---|
| Ball control (9 points) | 7.5 | 4.3 |
| Flight condition | Stable | Swayed slightly |
| Flight speed | Normal-fast | Fast |
| Overall rating (9 points) | 7.2 | 4.8 |

FIG. 3C

SYNTHETIC SHUTTLECOCK

BACKGROUND

1. Field of the Disclosure

The present disclosure relates to a synthetic shuttlecock, particularly to artificial feathers of synthetic shuttlecock.

2. Description of the Related Art

Badminton is a common and popular racket sport. Badminton gameplay involves a player using a racket to hit a shuttlecock. The main structure of the conventional shuttlecock is such that natural feathers are embedded into a rounded cock base. Most of these natural feathers are collected from geese or ducks, and after being bleached, the proper natural feathers are selected to make a shuttlecock. However, the acquisition of natural feathers is becoming more and more difficult, and the screening process is complicated and labor-intensive. Therefore, shuttlecocks with artificial feathers, herein referred to as synthetic shuttlecocks, are provided to solve the problem of the insufficiently of natural feathers and the complicated screening.

However, most of the synthetic shuttlecock designs replace the natural feathers with a plastic skirt made of nylon resin. The plastic skirt is a hollow structure so that the air current can pass through the plastic skirt. However, for the player, the feeling of hitting a synthetic shuttlecock is still different from that of hitting a natural feather shuttlecock, so most badminton players still use natural shuttlecocks.

Currently, the TW patent M539370 proposed artificial feathers made of plastic materials with a density between 0.9 $g/cm^3$ and 1.48 $g/cm^3$. The feathers are provided with intensive holes or slits. With such a design, the feeling of hitting may be more similar with the shuttlecock made of natural feathers. As shown in FIG. 1, which is a schematic diagram of a prior art synthetic shuttlecock, the (artificial) feathers 90 of the synthetic shuttlecock 9 have intensive holes 91. Each of the feathers 90 has about 20 holes 91. However, the number of holes 91 is large and the area of one hole 91 is small, and some users may feel uncomfortable with the intensive holes 91 or the slits. Further, in the manufacture of the feathers 90, providing the intensive holes 91 or a slit on the feathers 90 requires several penetrating operations. Accordingly, there is a need for improvement.

SUMMARY

In view of the above issues, it is a primary objective of the present disclosure to provide a synthetic shuttlecock with the feathers provided with holes defined the size. This not only provides the feeling of hitting more similar with a shuttlecock made of natural feathers, but solves the problems that prior art feathers with intensive holes may cause discomfort to the user and the manufacturing steps are cumbersome.

To achieve the above objective, the present disclosure provides a synthetic shuttlecock, which includes a base portion, a plurality of stems, and a plurality of feathers. One end of each of the stems is inserted into the base portion. Two of the feathers are connected to one of the stems, and the two feathers are connected to two sides of the stems. A connecting portion is formed on the stems, respectively. The connecting portion has a front end and a rear end. Each of the feathers has a first length and a first width. Each of the feathers has two holes located on the two sides of the connecting portion respectively, and the holes are close to the front end of the connecting portion. A long axis of each of the two holes is parallel to the connecting portion. Each of the two holes has a second length and a second width. The ratio of the second length to the first length is between 0.22 and 0.31, and the ratio of the second width to the first width is between 0.06 and 0.28.

According to an embodiment of the present disclosure, each of the feathers is substantially a kite-shaped configuration and has a long diagonal and a short diagonal. The long diagonal overlaps to the connecting portion overlap. The first length is the length of the long diagonal, and the first width is the length of the short diagonal.

According to an embodiment of the present disclosure, the shape of each of the holes is substantially rectangular. The second length is between 8.2 mm and 10.7 mm, and the second width is between 1 mm and 3 mm.

According to an embodiment of the present disclosure, the first length is between 35 mm and 37 mm, and the first width is between 13 mm and 15 mm.

According to an embodiment of the present disclosure, each of the two holes has a front edge, and a vertical distance between the front edge of the hole and the front end of the connecting portion is a third length. The third length is between 3 mm and 8 mm According to an embodiment of the present disclosure, the front edge of the hole overlaps with the short diagonal.

According to an embodiment of the present disclosure, the front edge of the hole is closer to the front end of the connecting portion than the short diagonal.

According to an embodiment of the present disclosure, each the two holes has a rear edge, and the vertical distance between the rear edge of the hole and the rear end of the connecting portion is a fourth length. The fourth length is between 20 mm and 22 mm.

According to an embodiment of the present disclosure, there is a third width between each of the two holes and the connecting portion. The third width is between 1.4 mm and 2.5 mm.

According to an embodiment of the present disclosure, each of the feathers further includes at least two sub-holes located on the two sides of the connecting portion, respectively. The sub-holes are closer to the rear end of the connecting portion than the two holes.

According to an embodiment of the present disclosure, each of the sub-holes is a polygonal or a circular hole.

According to an embodiment of the present disclosure, the two holes and the sub-holes are configured to be symmetrical with the connecting portion as the axis of symmetry.

As described above, the feathers in the synthetic shuttlecock according to the present disclosure include two holes that provide wind resistance different from the rest part of the feathers. By limiting the size of the holes (the ratio of second length to first length is between 0.22 and 0.31, and the ratio of second width to first width is between 0.06 and 0.28), the resulting wind resistance changes is similar to the shuttlecock made of natural feathers. Therefore, when hitting the synthetic shuttlecock of the present disclosure, the feeling of hitting is similar with hitting a shuttlecock made of natural feathers.

Further, compared with the prior art feathers with a plurality of holes, the feathers of the synthetic shuttlecock in the present disclosure only need to be provided with two symmetrical holes to achieve the same effect of improving the feeling of hitting. This not only achieves simplifying the manufacturing process of feathers, but prevents the users from intensive fear.

BRIEF DESCRIPTION OF THE DRAWINGS

FIG. 3C a schematic diagram showing the comparison of the feeling of hitting between the feathers of the present embodiment and the prior art feathers with a plurality of holes;

DETAILED DESCRIPTION OF THE PREFERRED EMBODIMENT

Hereafter, the technical content of the present disclosure will be better understood with reference to preferred embodiments.

Figure 2:
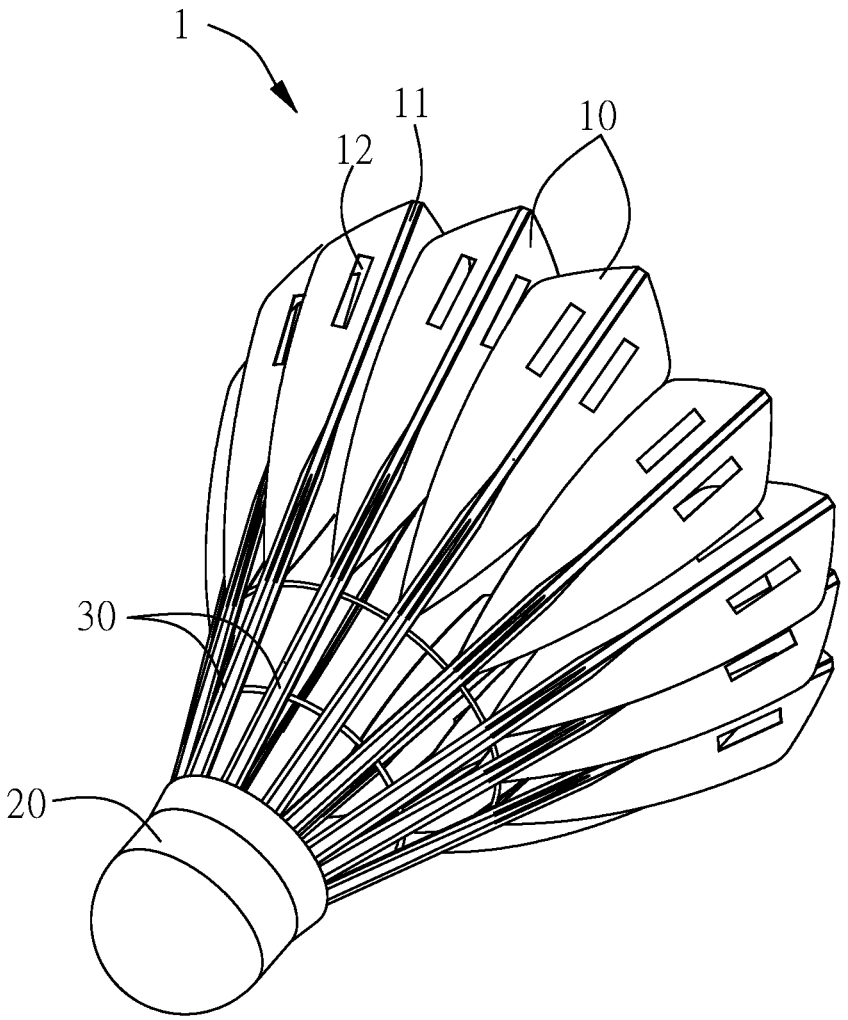
FIG. 2 is a perspective view of a shuttlecock according to an embodiment of the present disclosure.
Figure 3A:
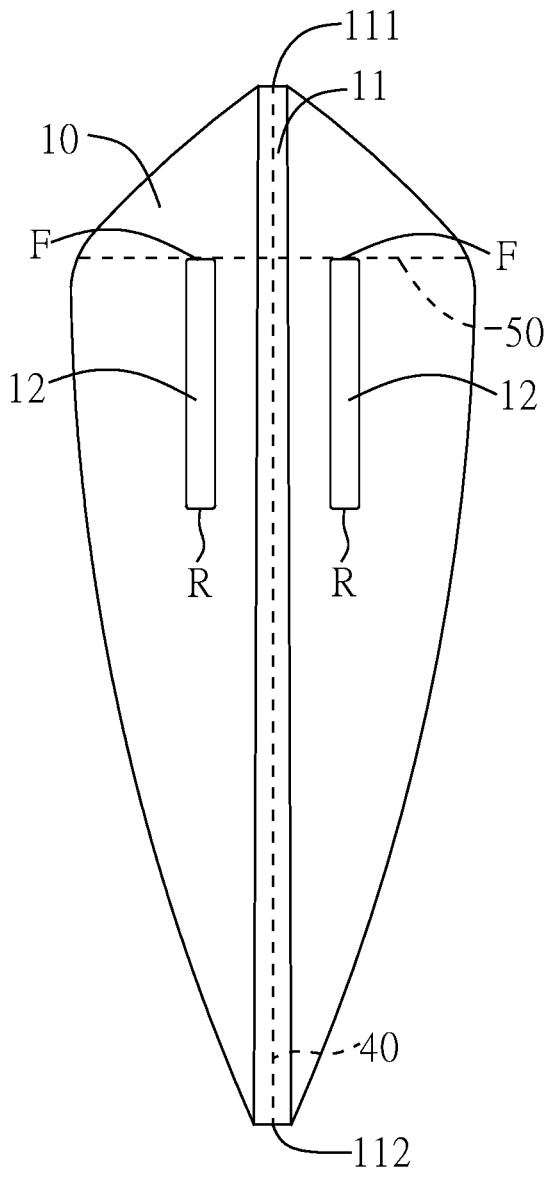
FIGS. 3A and 3B are schematic plan views of the feathers shown in FIG. 2.
Figure 3B:
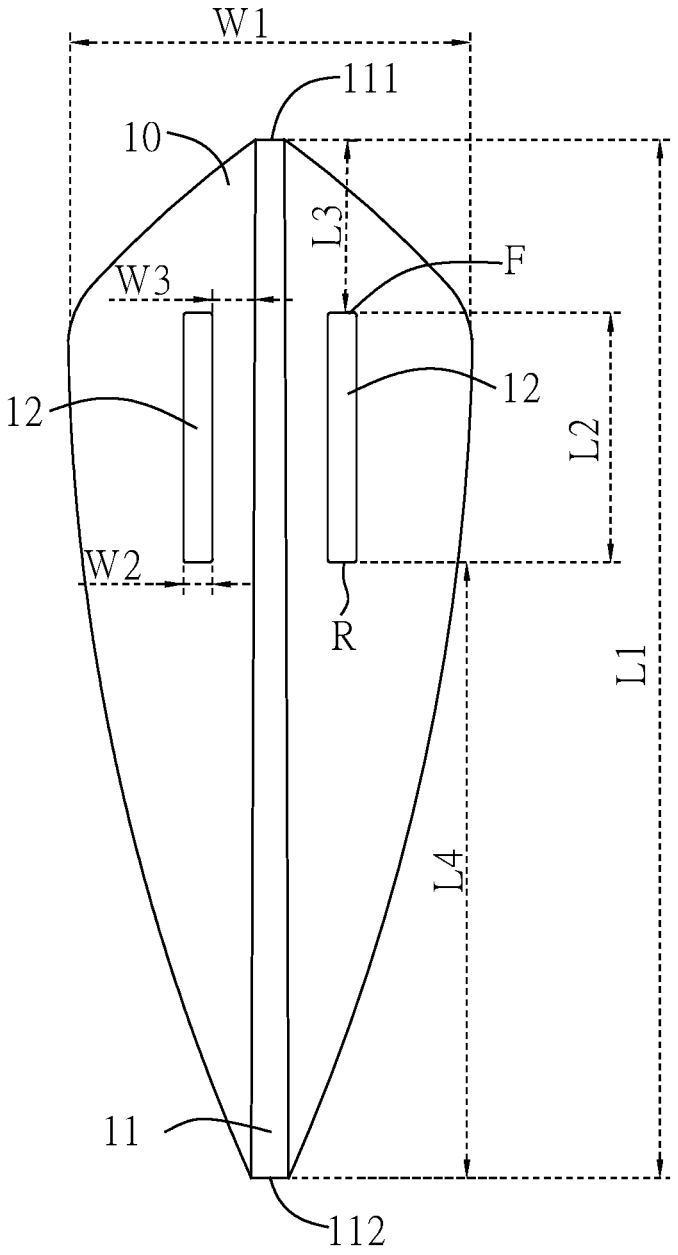

FIG. 2 is a perspective view of a shuttlecock according to an embodiment of the present disclosure. FIGS. 3A and 3B are schematic plan views of the feathers shown in FIG. 2. Specifically, FIG. 3B is a schematic diagram illustrating the size of feathers. Please refer to FIG. 2. A synthetic shuttlecock 1 in the present embodiment includes a plurality of feathers 10, a base portion 20, and a plurality of stems 30. The stems 30 are disposed on the base portion 20 in spaced. One end of each the stems 30 is inserted into the base portion 20, and the opposite end is provided with the feathers 10. It should be noted that, in this embodiment, with the special structure of the feathers 10, the feeling of hitting the synthetic shuttlecock 1 can be similar with hitting a shuttlecock made of natural feathers. Specifically, two feathers 10 are assembled with one stein 30. That is, two of the feathers 10 are connected to one of the stems 30. Further, two of the feathers 10 are connected to the two sides of the stein 30, respectively. A connecting portion 11 is formed on the stein 30. Specifically, one surface of the two feathers 10 are coated with glue, and the surfaces with the glue are adhered to the two sides of the stems 30. Finally, the rest parts of the two feathers 10 are pressed such that the two feathers 10 can also be glued to each other. It should be noted that, in this embodiment, the portion of the feather 10 adhered to the stein 30 is a connecting portion 11. Therefore, the connecting portion 11 and the stein 30 are both long and straight. The rest parts described above are the parts that are not adhered to the stein 30. Further, the connecting portion 11 is longitudinally arranged in the feathers 10. The connecting portion 11 has a front end 111 and a rear end 112 opposite to each other, and the rear end 112 is close to the base portion 20.

The feathers 10 of this embodiment are artificial feathers to replace the natural feathers. Specifically, the feathers 10 are made of plastic materials with a density between 0.9 $g/cm^3$ and 1.48 $g/cm^3$. The type of plastic materials can be, for example but not limited to, low density polyethylene (LDPE), Linear low density polyethylene (LLDPE), polyethylene terephthalate (PET), polyethylene (PE), polypropylene (PP), acrylonitrile-butadiene-styrene (ABS), polyamide (PA) and extruded polyethylene (EPE). Preferably, the feathers 10 can be a combination of LDPE and LLDPE.

Referring to FIG. 3A, the overall configuration of feathers 10 roughly corresponds to the configuration of the natural feathers of shuttlecock. Specifically, the feathers 10 may be in a mutually symmetrical configuration with the connecting portion 11 as the axis of symmetry. Taking the viewing angle of FIG. 3A as an example, the feathers 10 located on the left side and right side of the connecting portion 11 have a configuration respectively similar to an obtuse triangle. For example, the angle of the obtuse angle can be between 110 degrees and 135 degrees, and the adjacent two sides of the obtuse angle are curved. This makes the shape of feathers 10 relatively smooth. Since the feathers 10 located on the left side and right side of the connecting portion 11 of the embodiment are not flat obtuse triangles, it is called an obtuse-like triangle configuration. In other embodiments, the shape of the feathers 10 can also be adjusted according to the required feeling of hitting.

Specifically, the feather 10 in this embodiment is substantially a kite-shaped configuration, and has a long diagonal 40 and a short diagonal 50. The position of the long diagonal 40 substantially overlaps to the connecting portion 11. Further, the feather 10 has a first length L1 and a first width W1. The first length L1 is the length of the long diagonal 40, and the first width W1 is the length of the short diagonal 50. Preferably, the first length L1 may be between 35 mm and 37 mm, and the first width W1 may be between 13 mm and 15 mm Further, the thickness of feathers 10 is between 0.7 mm and 1.8 mm The manufacturer can adjust the required area and thickness according to the required weight and wind resistance.

In the present embodiment, each of the feathers 10 includes two holes 12 located on the two sides of the connecting portion 11, respectively. Preferably, the holes 12 symmetrically arranged on two sides the feather 10 with the connecting portion 11 as the axis of symmetry. The holes 12 on both sides of the feather 10 are substantially the same configuration, and the hole 12 on one side is taken as an example for illustration hereafter. In the present embodiment, the hole 12 has an elongated structure. Preferably, the shape of the hole 12 is substantially rectangular, and the long axis of the hole 12 is parallel to the connecting portion 11. Specifically, the manufacturer can use a cutting tool to cut on both sides of the connecting portion 11, and cut off parts of the plastic fibers of the feathers 10. Preferably, the cutter has a rectangular structure, and the long axis of the cutter is arranged in parallel with the connecting portion 11, and then cut the feathers 10 to form a rectangular hole which is the hole 12.

In the present embodiment, most region of the feathers 10 (the region having no hole 12) has a high density of plastic fibers, and the hole 12 is the region free of plastic fibers. The synthetic shuttlecock 1 can produce different wind resistances by the difference in material density between the hole 12 and the other areas of the feathers 10 during flight. In the present embodiment, through defining the size of the hole 12, the synthetic shuttlecock 1 can generate different wind resistances during flight, and can also produce different hitting sensations. The preferred embodiment of the present disclosure will be described hereafter as an example.

Each of the holes 12 has a second length L2 and a second width W2. In the present embodiment, the size of the holes 12 is limited as follows: the ratio of the second length L2 to the first length L1 is between 0.22 and 0.31; and the ratio of the second width W2 to the first width W1 is between 0.06 and 0.28. Preferably, the second length L2 may be between 8.2 mm and 10.7 mm; and the second width W2 may be between 1 mm and 3 mm For example, the second length L2 of the holes 12 in the present embodiment is 8.65 mm, and the second width W2 is 1 mm Therefore, the area of the holes 12 in the present embodiment is 8.65 $mm^2$ In the present embodiment, it is only to separately provide the hole 12 with the above limitation on the two sides of the connecting portion 11, and the feathers 10 can generate different wind resistance when the synthetic shuttlecock 1 be hit, so as to enhance the effect of feeling of hitting.

Not only the size of the hole 12, but the distribution of the hole 12 also produces a different sense of hitting. Preferably, the hole 12 is near the front end 111 of the feathers 10 and close to the connecting portion 11. Specifically, the hole 12 includes a front edge F. The vertical distance between the front edge F of the hole 12 and the front end 111 of the connecting portion 11 is a third length L3. The third length L3 is between 3 mm and 8 mm In the present embodiment, the front edge F of the hole 12 overlaps with the short diagonal 50. The third length L3 may be between 5.5 mm and 6 mm Further, there is a third width W3 between the holes 12 and the connecting portion 11. The third width W3 may be between 1.4 mm and 2.5 mm, preferably 1.44 mm.

Figure 1:
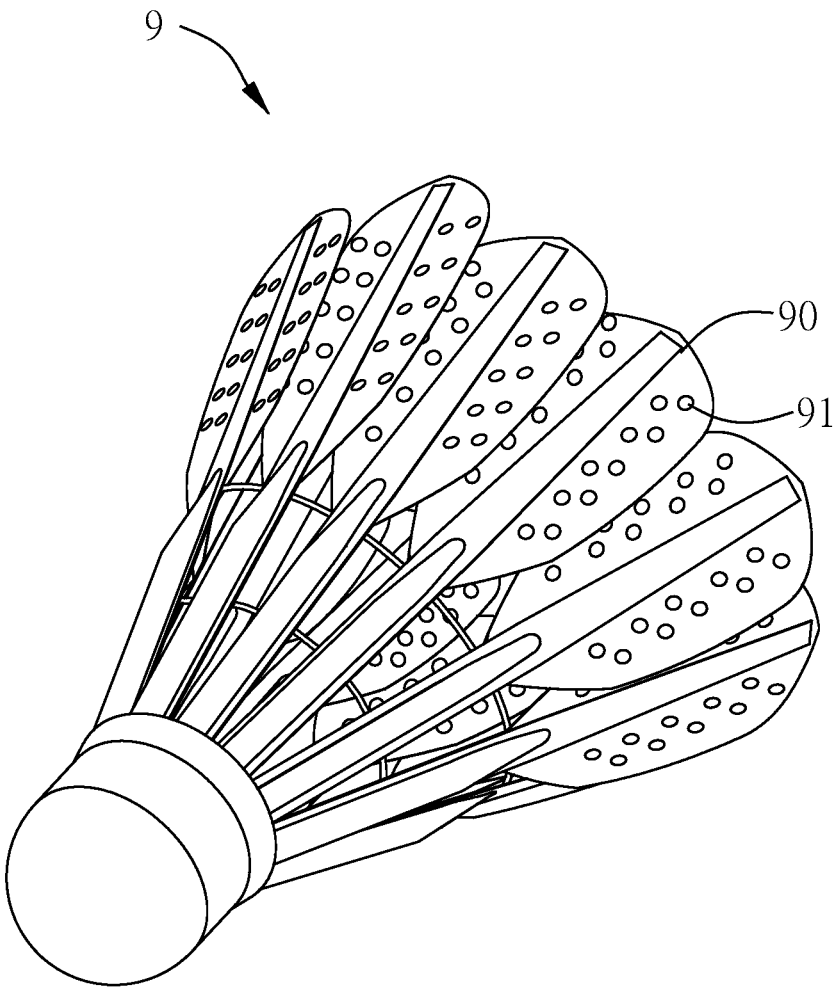
FIG. 1 (Prior art)
FIG. 1 is a schematic diagram of a prior art synthetic shuttlecock.

In addition, the hole 12 of the present embodiment has a rear edge R, the vertical distance between the rear edge R of the hole 12 and the rear end 112 of the connecting portion 11 is a fourth length L4, and the fourth length L4 may be between 20 mm and 22 mm, preferably 21.35 mm Compared with the plural holes of the prior art feathers, in this embodiment, only needs to provide the symmetrical two holes 12 on the feathers 10, so as to achieve the same effect of improving the feeling of hitting. Not only simplifying the manufacturing process of the feathers 10, but also allows users with intensive phobia to avoid situations of intense fear. Please refer to FIG. 3C, which is a schematic diagram showing the results of the sensation test using the synthetic shuttlecock 1 of the present embodiment and the prior art shuttlecock 9. Each of the feathers 10 of the synthetic shuttlecock 1 has two holes of about 8.65 $mm^2$, as shown in FIG. 2. Prior art feathers 90 of the synthetic shuttlecock 9 has about twenty holes 91 having an area of about 1 $mm^2$, as shown in FIG. 1. It should be noted that the field of the "ball control (9 points)" in FIG. 3C is the "ball control" rating on the synthetic shuttlecock 1 of the present embodiment and the prior art synthetic shuttlecock 9 by users with the net lunge stroke skill, out of 9 points. As shown in FIG. 3C, compared the prior art synthetic shuttlecock 9 (4.3 points) with the synthetic shuttlecock 1 (7.5 points) of the present embodiment, the user can more easily control the path of the synthetic shuttlecock 1 of the present embodiment. Furthermore, the synthetic shuttlecock 1 of this embodiment is superior to the prior art synthetic shuttlecock, in terms of the flight condition and speed. From the results of the "overall rating" of FIG. 3C, it can be seen that the feathers 10 of the present embodiment can not only replace the prior art feathers 90 having a plurality of holes 91, but also have better effects than the prior art feathers 90.

Figure 4:
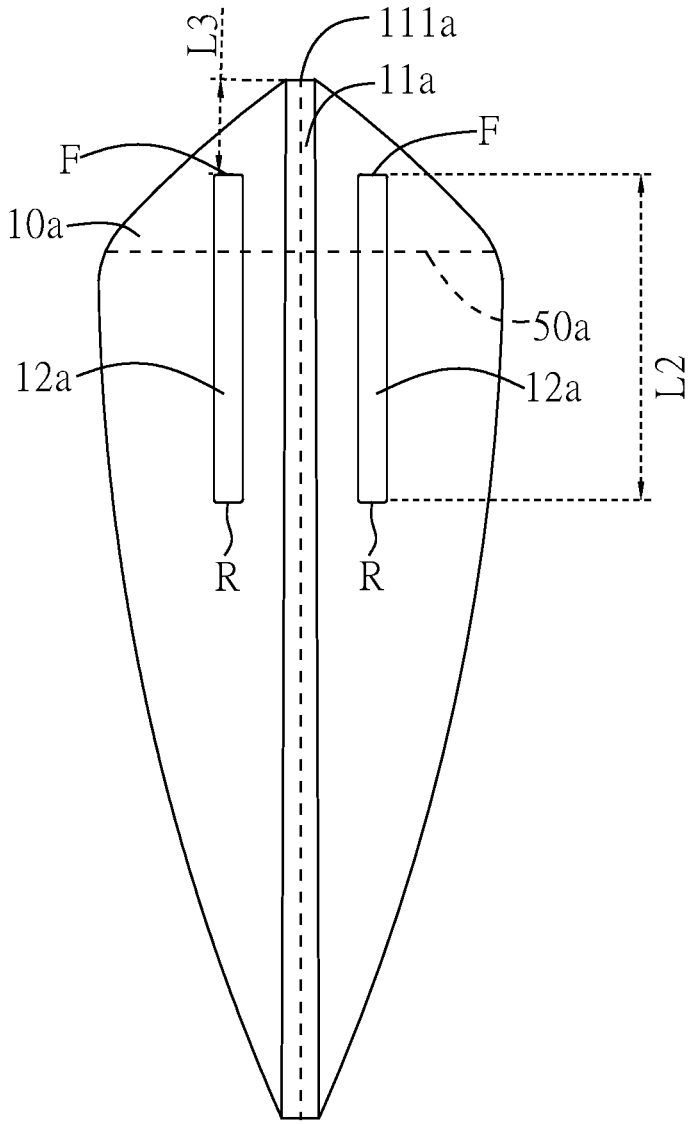
FIG. 4 is a schematic diagram of the feathers in a second embodiment of the present disclosure.

In other embodiments, the front edge F of the hole 12 may also be closer to the front end 111 of the connecting portion 11 than the short diagonal 50, as shown in FIG. 4. FIG. 4 is a schematic view of the feathers 10*a* in the second embodiment of the present disclosure. In the second embodiment, the third length L3 between the front edge F of the hole 12*a* and the front end 111*a* of the connecting portion 11*a* may be 4 mm. The second length L2 of the hole 12*a* itself may be 10.65 mm For other sizes and configuration restrictions, please refer to the feathers 10 in the first embodiment, which will not be detailed here.

Figure 5:
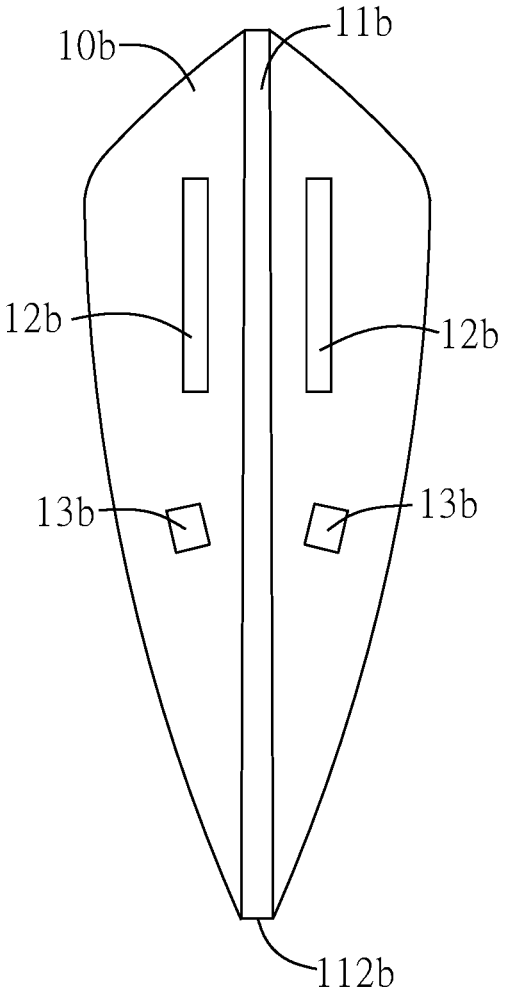
FIG. 5 is a schematic diagram of the feathers in a third embodiment of the present disclosure.

As described above, the holes 12, 12*a* in the present embodiment are substantially long and straight. In other embodiments, in addition to the holes 12, 12*a*, the feather 10 include other sub-holes. FIG. 5 is a schematic diagram of the feathers 10*b* in the third embodiment of the present disclosure. Referring to FIG. 5, each of the feathers 10*b* further includes at least two sub-holes 13*b*. FIG. 5 shows two sub-holes 13*b* as an example, and the two sub-holes 13*b* are located on the two sides of the connecting portion 11*b*, respectively. Preferably, the two sub-holes 13*b* are symmetrical to each other. That is, the two sub-holes 13*b* are symmetrically configured in the feathers 10*b* with the connecting portion 11*b* as the axis of symmetry. Further, the sub-holes 13*b* are closer to the rear end 112*b* of the connecting portion 11*b* than the holes 12*b*. Moreover, the sub-holes 13*b* in this embodiment are polygonal holes, and quadrilateral holes are used as an example.

Figure 6:
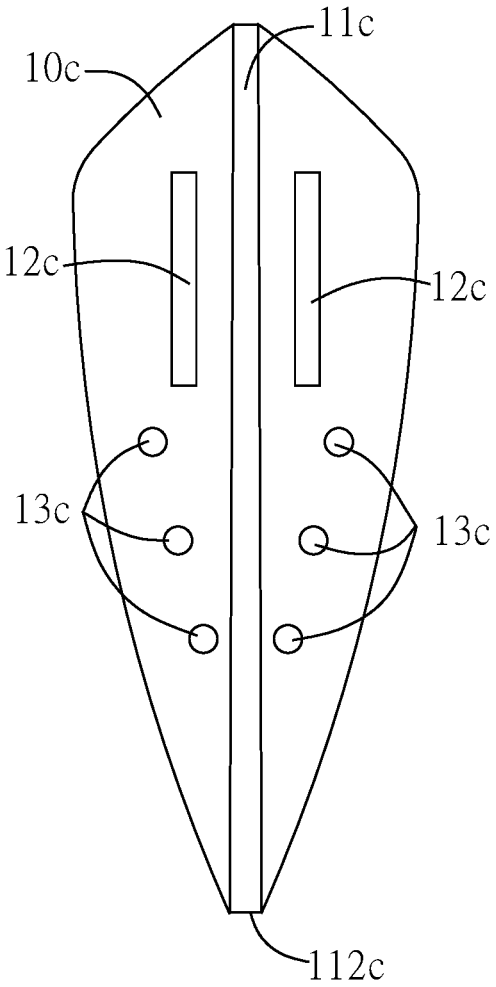
FIG. 6 is a schematic diagram of the feathers in a fourth embodiment of the present disclosure.

In addition, the present disclosure does not limit the number or shape of the sub-holes 13*b*. FIG. 6 is a schematic diagram of the feathers 10*c* in the fourth embodiment of the present disclosure. Referring to FIG. 6, in the present embodiment, the feathers 10*c* include six sub-holes 13*c* symmetrically located on the two sides of the connecting portion 11*c*, and three sub-holes 13*c* located on the left side of the connecting portion 11*c*, and three sub-holes 13*c* located on the right side of the connecting portion 11*c*. Further, the sub-holes 13*c* of the present embodiment are configured as a circular hole. In other embodiments, the sub-holes 13*c* may also have other irregular shapes, and the present disclosure is not limited thereto. Similarly, the sub-holes 13*c* are closer to the rear end 112*c* of the connecting portion 11*c* than the holes 12*c*, and the holes 12*c* and the sub-holes 13*c* can also be symmetrically arranged in the feather 10*c* with the connecting portion 11*c* as the axis of symmetry.

As described above, the feathers of the synthetic shuttlecock according to the present disclosure include two holes that provide wind resistance different from the rest part of the feathers. By limiting the size of the holes (the ratio of the second length to the first length is between 0.22 and 0.31, and the ratio of the second width to the first width is between 0.06 and 0.28), the resulting wind resistance changes is similar to the shuttlecock made of natural feathers. Therefore, when hitting the synthetic shuttlecock of the present disclosure, the feeling of hitting is similar with hitting the shuttlecock made of natural feathers.

Further, compared with the prior art feathers with a plurality of holes, the feathers of the synthetic shuttlecock in the present disclosure only need to be provided with two symmetrical holes to achieve the same effect of improving the feeling of hitting. This not only achieves simplifying the manufacturing process of feathers, but prevents the users from intensive fear.

It should be noted that the described embodiments are only for illustrative and exemplary, and that various changes and modifications may be made to the described embodiments without departing from the scope of the disclosure as disposed by the appended claims.

What is claimed is:

1. A synthetic shuttlecock, comprising:

a base portion;

a plurality of stems, one end of each the stems being inserted in the base portion; and a plurality of feathers, wherein two of the feathers are connected to one of the stems, and the two feathers are connected to two sides of the stems, and a connecting portion is formed on the stems respectively, the connecting portion having a front end and a rear end, each of the feathers having a first length and a first width, and each of the feathers comprising:

only two holes, symmetrically located on two sides of the connecting portion respectively, close to the front end of the connecting portion, wherein a long axis of each the two holes is parallel to the connecting portion, each of the two holes has a second length and a second width, a ratio of the second length to the first length is between 0.22 and 0.31, and a ratio of the second width to the first width is between 0.06 and 0.28.

2. The synthetic shuttlecock as claimed in claim 1, wherein each of the feathers is substantially a kite-shaped configuration having a long diagonal and a short diagonal, the long diagonal overlaps the connecting portion, the first length is the length of the long diagonal, and the first width is the length of the short diagonal.

3. The synthetic shuttlecock as claimed in claim 2, wherein a shape of each of the two holes is substantially rectangular, the second length is between 8.2 mm and 10.7 mm, and the second width is between 1 mm and 3 mm.

4. The synthetic shuttlecock as claimed in claim 3, wherein the first length is between 35 mm and 37 mm, and the first width is between 13 mm and 15 mm.

5. The synthetic shuttlecock as claimed in claim 2, wherein each of the two holes has a front edge, a vertical distance between the front edge of the hole and the front end of the connecting portion is a third length, and the third length is between 3 mm and 8 mm.

6. The synthetic shuttlecock as claimed in claim 5, wherein the front edge of the hole overlaps with the short diagonal.

7. The synthetic shuttlecock as claimed in claim 5, wherein the front edge of the hole is closer to the front end of the connecting portion than the short diagonal.

8. The synthetic shuttlecock as claimed in claim 2, wherein each of the two holes has a rear edge, a vertical distance between the rear edge of the hole and the rear end of the connecting portion is a fourth length, and the fourth length is between 20 mm and 22 mm.

9. The synthetic shuttlecock as claimed in claim 2, wherein there is a third width between each of the two holes and the connecting portion, and the third width is between 1.4 mm and 2.5 mm.

10. The synthetic shuttlecock as claimed in claim 2, wherein each of the feathers further includes at least two sub-holes located on the two sides of the connecting portion respectively, and the sub-holes are closer to the rear end of the connecting portion than the two holes.

11. The synthetic shuttlecock as claimed in claim 10, wherein each of the sub-holes is a polygonal or a circular hole.

12. The synthetic shuttlecock as claimed in claim 10, wherein the two holes and the sub-holes are configured to be symmetrical with the connecting portion as an axis of symmetry.

* * * * *